US007156151B2

(12) United States Patent
Mahapatra et al.

(10) Patent No.: US 7,156,151 B2
(45) Date of Patent: Jan. 2, 2007

(54) CASTING STEEL STRIP

(75) Inventors: Rama Ballay Mahapatra, Brighton-Le-Sands (AU); Eugene B. Pretorius, Mt. Pleasant, SC (US); David J. Sosinsky, Camel, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 10/961,300

(22) Filed: Oct. 8, 2004

(65) Prior Publication Data

US 2005/0082031 A1 Apr. 21, 2005

Related U.S. Application Data

(60) Provisional application No. 60/510,479, filed on Oct. 10, 2003.

(51) Int. Cl.
*B22D 11/00* (2006.01)
*B22D 11/06* (2006.01)

(52) U.S. Cl. ..... 164/480; 164/459

(58) Field of Classification Search ..... 184/459, 184/479–480

See application file for complete search history.

(56) References Cited

U.S. PATENT DOCUMENTS

| | | | |
|---|---|---|---|
| 3,670,400 | A | 6/1972 | Singer |
| 4,006,044 | A | 2/1977 | Oya et al. |
| 5,103,895 | A | 4/1992 | Furuya et al. |
| 5,106,412 | A | 4/1992 | Bogan et al. |
| 5,180,450 | A | 1/1993 | Rao |
| 5,320,687 | A | 6/1994 | Kipphut et al. |
| 5,720,336 | A | 2/1998 | Strezov |
| 5,820,817 | A | 10/1998 | Angeliu et al. |
| 5,906,791 | A | 5/1999 | Angeliu |
| 6,290,787 | B1 | 9/2001 | Babbit et al. |
| 6,328,826 | B1 | 12/2001 | Iung et al. |
| 6,372,057 | B1 | 4/2002 | Fujimura et al. |
| 6,478,899 | B1 | 11/2002 | Legrand et al. |
| 6,588,494 | B1 | 7/2003 | Mazurier et al. |
| 6,622,779 | B1 | 9/2003 | Mazurier |

FOREIGN PATENT DOCUMENTS

| | | |
|---|---|---|
| EP | 0 922 511 A1 | 6/1999 |
| JP | 52-139622 | 11/1977 |
| JP | 58-45321 | 3/1983 |
| JP | 64-83339 | 3/1989 |
| JP | 4-279246 | 10/1992 |
| JP | 11-179489 | 7/1999 |
| JP | 2001-220642 | 8/2001 |
| JP | 2002361372 | 2/2003 |
| JP | 2003-154441 | 5/2003 |
| WO | WO 98/28452 | 7/1998 |

OTHER PUBLICATIONS

Sosinsky, D.J., et al., Determination and Prediction of Water Vapor Solubilities in CaO-MgO-$SiO_2$ Slags, Mar. 1985, Metallurgical Transactions B, vol. 16B, pp. 61-66.

Zasowski, Peter J., et al., "Control of Heat Removal in the Continuous Casting Mould," 1990 Steelmaking Conference Proceedings, pp. 253-259.

*Primary Examiner*—Kuang Y. Lin
(74) *Attorney, Agent, or Firm*—Hahn Loeser & Parks LLP; Arland T. Stein

(57) ABSTRACT

A method of casting steel strip by introducing molten plain carbon steel on casting surfaces at least one casting roll with the molten steel having a free nitrogen content below 120 ppm and a free hydrogen content below about 6.5 ppm measured at atmospheric pressure. The free nitrogen content maybe below about 100 ppm or below about 85 ppm. The free hydrogen content maybe between 1.0 and 6.5 ppm at atmospheric pressure. Novel cast strip of plain carbon steel is produced having a strip thickness less than 5 mm or less than 2 mm by use of the method.

16 Claims, 3 Drawing Sheets

CASTING STEEL STRIP

This application claims priority to and the benefit of U.S. provisional patent application No. 60/510,479 filed Oct. 10, 2003, the disclosure of which is incorporated herein by reference.

BACKGROUND AND SUMMARY OF THE DISCLOSURE

This invention relates to the casting of steel strip. It has particular application for continuous casting of thin steel strip less than 5 mm in thickness in a roll caster.

In a roll caster, molten metal is cooled on casting surfaces of at least one casting roll and formed in to thin cast strip. In roll casting with a twin roll caster, molten metal is introduced between a pair of counter rotated casting rolls that are cooled. Steel shells solidify on the moving casting surfaces and are brought together at a nip between the casting rolls to produce a solidified sheet product delivered downwardly from the nip. The term "nip" is used herein to refer to the general region in which the casting rolls are closest together. In any case, the molten metal is usually poured from a ladle into a smaller vessel, from where it flow through a metal delivery system to distributive nozzles located generally above the casting surfaces of the casting rolls. In twin roll casting, the molten metal is delivered between the casting rolls to form a casting pool of molten metal supported on the casting surfaces of the rolls adjacent to the nip and extending along the length of the nip. Such casting pool is usually confined between side plates or dams held in sliding engagement adjacent to ends of the casting rolls, so as to dam the two ends of the casting pool.

When casting thin steel strip with a twin roll caster, the molten metal in the casting pool will generally be at a temperature of the order of 1500° C. and above. It is therefore necessary to achieve very high cooling rates over the casting surfaces of the casting rolls. A high heat flux and extensive nucleation on initial solidification of the metal shells on the casting surfaces is needed to form the steel strip. U.S. Pat. No. 5,760,336 incorporated herein by reference describes how the heat flux on initial solidification can be increased by adjusting the steel melt chemistry such that a substantial portion of the metal oxides formed are liquid at the initial solidification temperature, and in turn, a substantially liquid layer formed at the interface between the molten metal and each casting surface. As disclosed in U.S. Pat. Nos. 5,934,359 and 6,059,014 and International Application AU 99/00641, the disclosures of which are incorporated herein by reference, nucleation of the steel on initial solidification can be influenced by the texture of the casting surface. In particular, International Application AU 99/00641 discloses that a random texture of peaks and troughs in the casting surfaces can enhance initial solidification by providing substantial nucleation sites distributed over the casting surfaces.

Attention has been given in the past to the steel chemistry of the melt, particularly in the ladle metallurgy furnace before thin strip casting. We have given attention in the past to the oxide inclusions and the oxygen levels in the steel metal and their impact on the quality of the steel strip produced. We have now found that the quality of the steel strip and the production of the thin steel strip is also enhanced by control of the hydrogen levels and nitrogen levels in the molten steel. Controlling hydrogen and nitrogen levels has in the past been the subject of investigation in slab casting, but to our knowledge has not been a focus of attention in thin strip casting. For example, see *Control of Heat Removal in the Continuous Casting Mould*, by P. Zasowski and D. Sosinsky, 1990 Steelmaking Conference Proceedings, 253–259; and *Determination and Prediction of Water Vapor Solubilities in CaO—MgO—$SiO_2$ Slags*, by D. Sosinsky, M. Maeda and A. Mclean, Metallurgical Transactions, vol. 16b, 61–66 (March 1985).

Specifically we have found that by controlling the hydrogen and nitrogen levels in the steel melt, with low levels of sulfur in the steel, plain carbon steel strip having unique composition and production qualities can be produced by roll casting. There is provided a method of casting steel strip comprising:

introducing molten plain carbon steel on casting surfaces of at least one casting roll with the molten steel having a free nitrogen content below about 120 ppm and a free hydrogen content below about 6.9 ppm measured at atmospheric pressure and such that the sum of partial pressure of nitrogen and partial pressure of hydrogen is no more than 1.15 atmospheres;

forming a casting pool of molten metal on the eastine surfaces of the casting rolls; and solidifying the molten steel to form metal shells on the casting rolls having nitrogen and hydrogen levels reflected by the content thereof in the molten steel to form thin steel strip. The content of the free hydrogen may be below about 6.5 ppm, and sum of partial pressure of nitrogen and partial pressure of hydrogen in the introduced molten metal may be no more than 1.0 atmosphere.

The method of casting steel strip may be carried out by the steps comprising the following:

assembling a pair of cooled casting rolls having a nip between them and confining end closures adjacent to ends of the casting rolls;

introducing molten plain carbon steel between the pair of casting rolls to form a casting pool on casting surfaces of the casting rolls with the end closures confining the pool, with the molten steel having a free nitrogen content below about 120 ppm and a free hydrogen content below about 6.9 ppm measured at atmospheric pressure and such that the sum of partial pressure of nitrogen and partial pressure of hydrogen is no more than 1.15 atmospheres; and counter-rotating the casting rolls and solidifying the molten steel to form metal shells on the casting rolls having nitrogen and hydrogen levels reflected by the content thereof in the molten steel to provide for the formation of thin steel strip; and forming solidified thin steel strip through the nip between the casting rolls to produce a solidified steel strip delivered downwardly from the nip. The content of the free hydrogen may be below about 6.5 ppm, and sum of partial pressure of nitrogen and partial pressure of hydrogen in the introduced molten metal may be no more than 1.0 atmosphere.

Alternatively, there is provided a method of casting steel strip comprising:

introducing molten plain carbon steel on casting roll surfaces of at least one casting roll having a free nitrogen content below about 100 ppm and a free hydrogen content below about 6.9 ppm measured at atmospheric pressure and such that the sum of partial pressure of nitrogen and partial pressure of hydrogen is no more than 1.15 atmospheres;

forming a casting pool of molten metal on the casting surfaces of the casting rolls; and solidifying the molten steel to form metal shells on the casting rolls having nitrogen and hydrogen levels reflected by the content thereof in the molten steel to form thin steel strip. The content of the free hydrogen may be below about 6.5 ppm, and sum of partial pressure of nitrogen and partial pressure of hydrogen in the introduced molten metal may be no more than 1.0 atmosphere.

The method of casting steel strip may be carried out by the steps comprising the following:

assembling a pair of cooled casting rolls having a nip between them and confining end closures adjacent to ends of the casting rolls;

introducing molten plain carbon steel between the pair of casting rolls to form a casting pool on casting surfaces of the casting rolls with the end closures confining the pool, with the molten steel having a free nitrogen content below about 100 ppm and a free hydrogen content below about 6.9 ppm measured at atmospheric pressure and such that the sum of partial pressure of nitrogen and partial pressure of hydrogen is no more than 1.15 atmospheres;

counter-rotating the casting rolls and solidifying the molten steel to form metal shells on the casting rolls having nitrogen and hydrogen levels reflected by the content thereof in the molten steel to provide for the formation of thin steel strip; and forming solidified thin steel strip through the nip between the casting rolls to produce a solidified steel strip delivered downwardly from the nip. The content of the free hydrogen may be below about 6.5 ppm, and sum of partial pressure of nitrogen and partial pressure of hydrogen in the introduced molten metal may be no more than 1.0 atmosphere.

As a further alternative, there is provided a method of casting steel strip comprising:

introducing molten plain carbon steel on casting surfaces of at least one casting roll with the molten steel having a free nitrogen content below about 85 ppm and a free hydrogen content below about 6.9 ppm measured at atmospheric pressure and such that the sum of partial pressure of nitrogen and partial pressure of hydrogen is no more than 1.15 atmospheres;

forming a casting pool of molten metal on the casting surfaces of the casting rolls; and solidifying the molten steel to form metal shells on the casting rolls having nitrogen and hydrogen levels reflected by the content thereof in the molten steel to form thin steel strip. The content of the free hydrogen may be below about 6.5 ppm, and sum of partial pressure of nitrogen and partial pressure of hydrogen in the introduced molten metal may be no more than 1.0 atmosphere.

The method of casting steel strip may be carried out by the steps comprising the following:

assembling a pair of cooled casting rolls having a nip between them and confining end closures adjacent to ends of the casting rolls;

introducing molten plain carbon steel between the pair of casting rolls to form a casting pool on the casting surfaces of the casting rolls with the end closure confining the pool, with the molten steel having a free nitrogen content below about 85 ppm and a free hydrogen content below about 6.9 ppm measured at atmospheric pressure and such that the sum of partial pressure of nitrogen and partial pressure of hydrogen is no more than 1.15 atmospheres;

counter-rotating the casting rolls and solidifying the molten steel to form metal shells on the casting rolls having nitrogen and hydrogen levels reflected by the content thereof in the molten steel to provide for the formation of thin steel strip; and forming solidified thin steel strip through the nip between the casting rolls to produce a solidified steel strip delivered downwardly from the nip. The content of the free hydrogen may be below about 6.5 ppm, and sum of partial pressure of nitrogen and partial pressure of hydrogen in the introduced molten metal may be no more than 1.0 atmosphere.

In any of these methods, the free nitrogen content may be 60 ppm or less, and the free hydrogen content may be 1.0 to 6.5 ppm. The free hydrogen content may, for example, be between 2.0 and 6.5 ppm or between 3.0 and 6.5 ppm.

Plain carbon steel for purpose of the present invention is defined as less than 0.65% carbon, less than 2.5% silicon, less than 0.5% chromium, less than 2.0% manganese, less than 0.5% nickel, less than 0.25% molybdenum and less than 1.0% aluminum, together with of other elements such as sulfur, oxygen and phosphorus which normally occur in making carbon steel by electric arc furnace. Low carbon steel may be used in these methods having a carbon content in the range 0.001% to 0.1% by weight, a manganese content in the range 0.01% to 2.0% by weight, and a silicon content in the range 0.01% to 2.5% by weight, and low carbon cast strip may be made by the method. The steel may have an aluminum content of the order of 0.01% or less by weight. The aluminum may, for example, be as little as 0.008% or less by weight. The molten steel may be a silicon/manganese killed steel.

In these methods, the sulfur content of the steel may be 0.01% or less; and the sulfur content of the steel may be 0.007% by weight.

In these methods, the free nitrogen may be measured by optical emission spectrometry, calibrated against the thermal conductivity method a described below. The free hydrogen levels may be determined by a Hydrogen Direct Reading Immersed System ("Hydris") unit, made by Hereaus Electronite.

The maximum allowable free nitrogen and free hydrogen levels may be for total pressure not to exceed 1.0 atmospheres. Higher pressures may be utilized in certain conditions, and the levels of free nitrogen and free hydrogen can be corresponding higher. For example, as explained below, a ferrostatic head may be 1.15, causing the free nitrogen levels and free hydrogen levels to be higher as shown in FIG. 3. But for purposes of the parameters of the present methods, the free nitrogen and free hydrogen levels are measured a 1.0 atmospheres even through the actual levels of free nitrogen and free hydrogen in the molten metal are higher when the methods are practiced with higher positive atmospheric pressure.

The present invention provides cast steel strip with unique properties that are described by the methods by which it is made. This steel strip is plain carbon steel.

BRIEF DESCRIPTION OF THE DRAWINGS

In order that the invention may be more fully explained, illustrative results of experimental work carried out to date will be described with reference to the accompanying drawings in which.

DETAILED DESCRIPTION OF THE DRAWINGS

Figure 1:
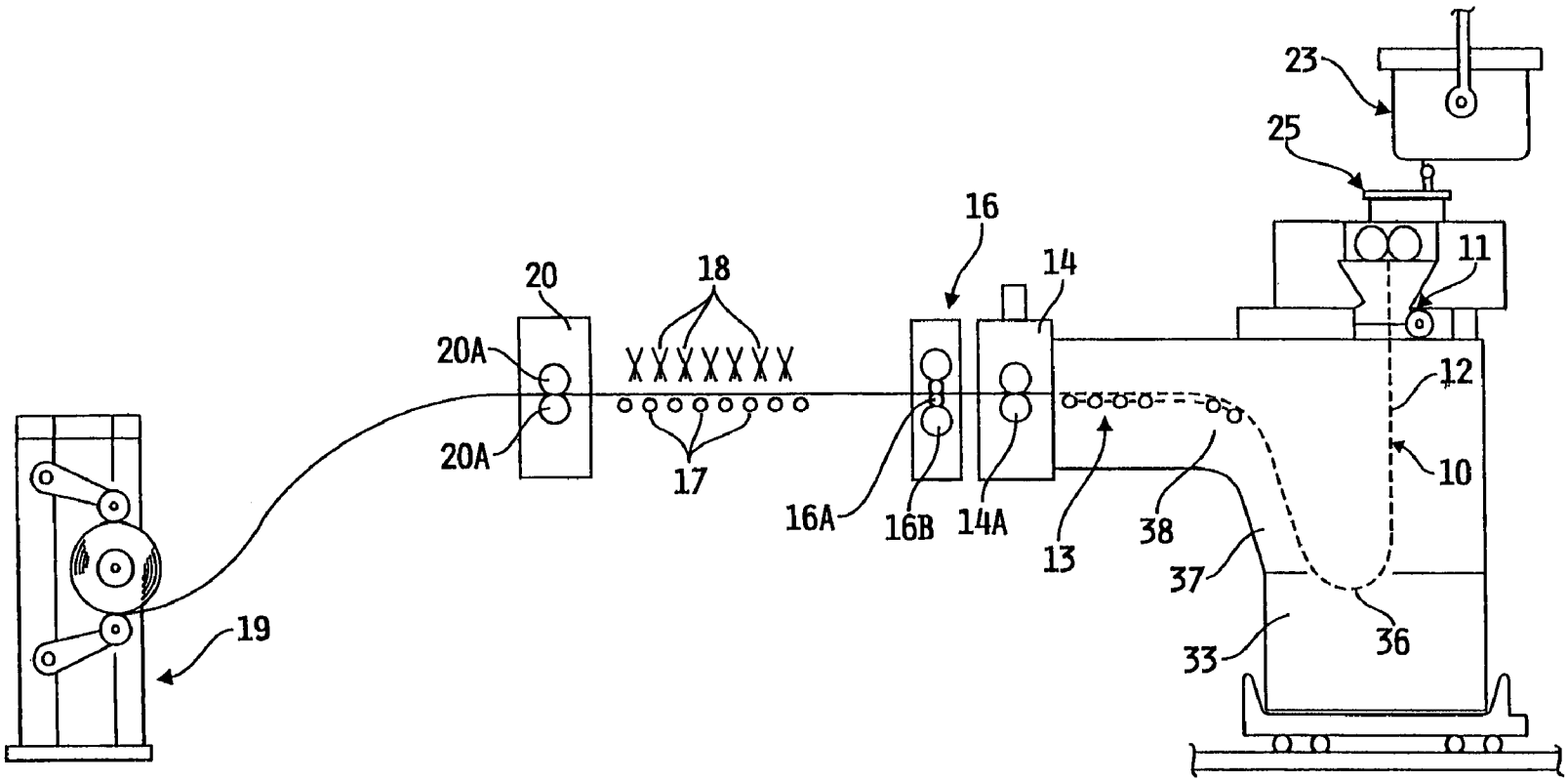
FIG. 1 is a diagrammatic side elevation view of an illustrative strip caster.
Figure 2:
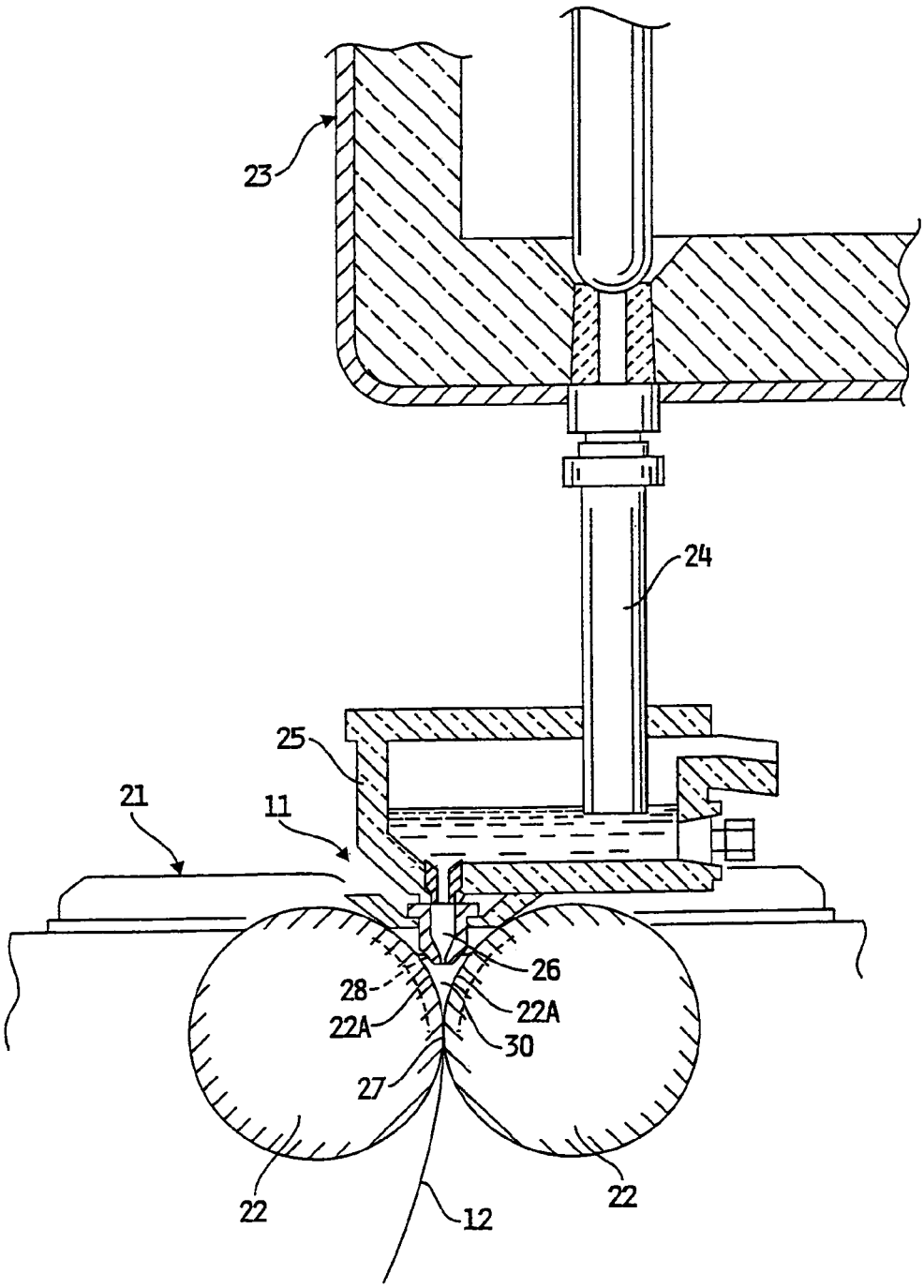
FIG. 2 is an enlarged sectional view of a portion of the caster of FIG. 1.

FIGS. 1 and 2 illustrate a twin roll continuous strip caster which has been operated in accordance with the present invention. The following description of the described embodiments is in the context of continuous casting steel strip using a twin roll caster. The present invention is not limited, however, to the use of twin roll casters and extends to other types of continuous strip casters.

FIG. 1 shows successive parts of an illustrative production line whereby steel strip can be produced in accordance with the present invention. FIGS. 1 and 2 illustrate a twin roll caster denoted generally as 11 which produces a cast steel strip 12 that passes in a transit path 10 across a guide table 13 to a pinch roll stand 14 comprising pinch rolls 14A. Immediately after exiting the pinch roll stand 14, the strip may pass into a hot rolling mill 16 comprising a pair of reduction rolls 16A and backing rolls 16B by in which it is hot rolled to reduce its thickness. The rolled strip passes onto a run-out table 17 on which it may be cooled by convection by contact with water supplied via water jets 18 (or other suitable means) and by radiation. In any event, the rolled strip may then pass through a pinch roll stand 20 comprising a pair of pinch rolls 20A and thence to a coiler 19. Final cooling (if necessary) of the strip takes place on the coiler.

As shown in FIG. 2, twin roll caster 11 comprises a main machine frame 21 which supports a pair of cooled casting rolls 22 having a casting surfaces 22A, assembled side-by-side with a nip between them. Molten metal of plain carbon steel may be supplied during a casting operation from a ladle (not shown) to a tundish 23, through a refractory shroud 24 to a distributor 25 and thence through a metal delivery nozzle 26 generally above the nip 27 between the casting rolls 22. The molten metal thus delivered to the nip 27 forms a pool 30 supported on the casting roll surfaces 22A above the nip and this pool is confined at the ends of the rolls by a pair of side closures, dams or plates 28, which may be positioned adjacent the ends of the rolls by a pair of thrusters (not shown) comprising hydraulic cylinder units (or other suitable means) connected to the side plate holders. The upper surface of pool 30 (generally referred to as the "meniscus" level) may rise above the lower end of the delivery nozzle so that the lower end of the delivery nozzle is immersed within this pool.

Casting rolls 22 are water cooled so that shells solidify on the moving casting surfaces of the rolls. The shells are then brought together at the nip 27 between the casting rolls sometimes with molten metal between the shells, to produce the solidified strip 12 which is delivered downwardly from the nip.

Frame 21 supports a casting roll carriage which is horizontally movable between an assembly station and a casting station.

Casting rolls 22 may be counter-rotated through drive shafts (not shown) driven by an electric, hydraulic or pneumatic motor and transmission. Rolls 22 have copper peripheral walls formed with a series of longitudinally extending and circumferentially spaced water cooling passages supplied with cooling water. The rolls may typically be about 500 mm in diameter and up to about 2000 mm long in order to produce strip product of about 2000 mm wide.

Tundish 25 is of conventional construction. It is formed as a wide dish made of a refractory material such as for example magnesium oxide (MgO). One side of the tundish receives molten metal from the ladle and is provided with an overflow spout 24 and an emergency plug 25.

Delivery nozzle 26 is formed as an elongate body made of a refractory material such as for example alumina graphite. Its lower part is tapered so as to converge inwardly and downwardly above the nip between casting rolls 22.

Nozzle 26 may have a series of horizontally spaced generally vertically extending flow passages to produce a suitably low velocity discharge of molten metal throughout the width of the rolls and to deliver the molten metal between the rolls onto the roll surfaces where initial solidification occurs. Alternatively, the nozzle may have a single continuous slot outlet to deliver a low velocity curtain of molten metal directly into the nip between the rolls and/or the nozzle may be immersed in the molten metal pool.

The pool is confined at the ends of the rolls by a pair of side closure plates 28 which are adjacent to and held against stepped ends of the rolls when the roll carriage is at the casting station. Side closure plates 28 are illustratively made of a strong refractory material, for example boron nitride, and have scalloped side edges to match the curvature of the stepped ends of the rolls. The side plates can be mounted in plate holders which are movable at the casting station by actuation of a pair of hydraulic cylinder units (or other suitable means) to bring the side plates into engagement with the stepped ends of the casting rolls to form end closures for the molten pool of metal formed on the casting rolls during a casting operation.

The twin roll caster may be of the kind illustrated and described in some detail in, for example, U.S. Pat. Nos. 5,184,668; 5,277,243; 5,488,988; and/or 5,934,359; U.S. patent application Ser. No. 10/436,336; and International Patent Application PCT/AU93/00593, the disclosures of which are incorporated herein by reference. Reference may be made to those patents for appropriate constructional details but forms no part of the present invention.

Figure 3:
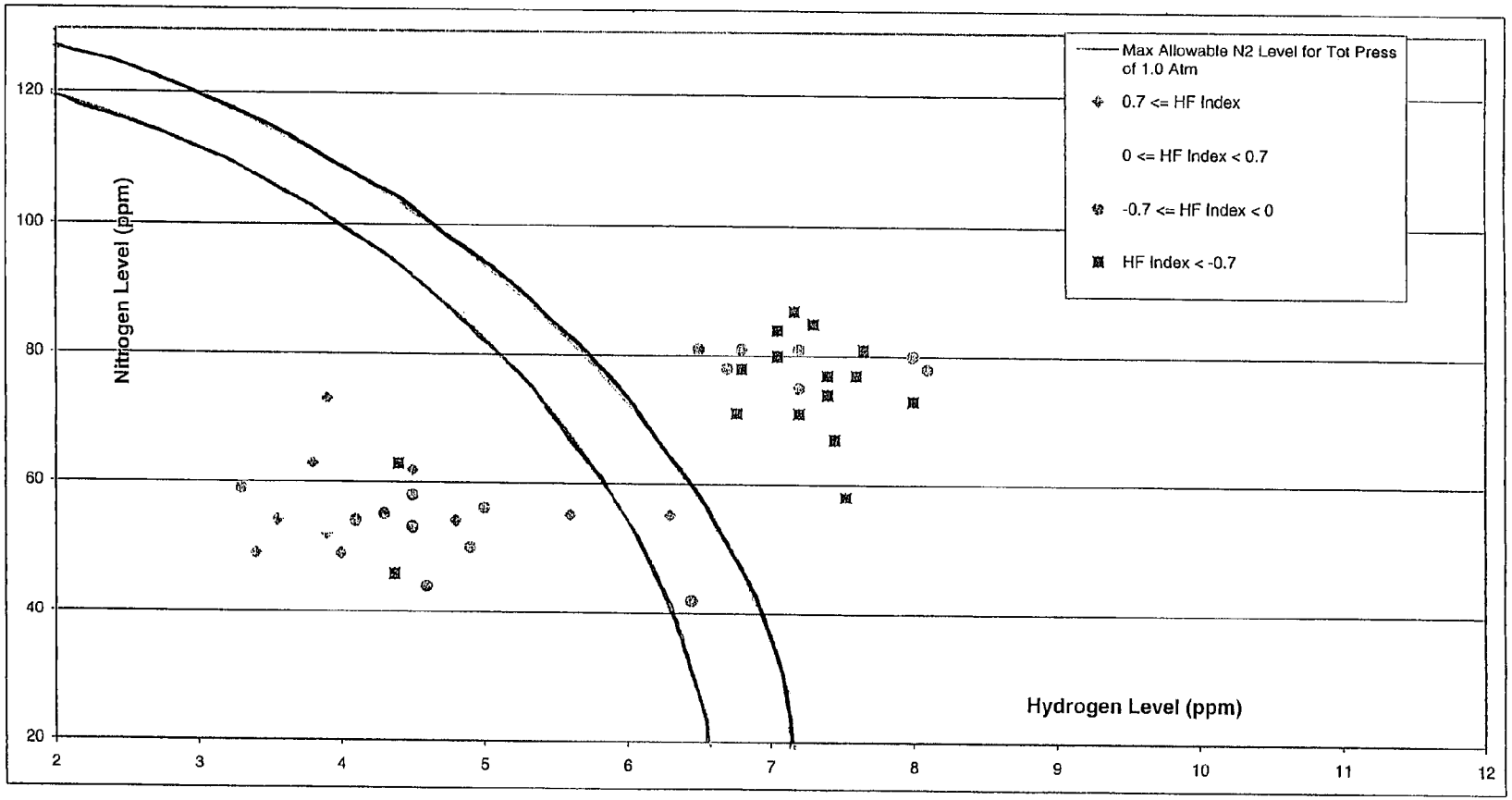
FIG. 3 is a graph showing allowable nitrogen levels and hydrogen levels in low carbon steel for a cast steel strip.

Results of the control of the free nitrogen and hydrogen levels in thin cast sheets of plain carbon steel are set out in Table 1 and in FIG. 3. As FIG. 3 shows, where the free nitrogen level was below about 85 ppm and the free hydrogen level was below about 6.5 ppm the thin cast strip produced was of premium "cold-rolled" steel quality. The heat(s) where the free nitrogen or free hydrogen level were above about 85 ppm or about 6.5 ppm, respectively, did not produce thin cast strip of premium cold-rolled steel quality. We have found, however, that hydrogen level is the significant parameter and the nitrogen level can be higher up to 100 ppm or 120 ppm The results shown in FIG. 3 are for plain carbon thin rolled steel. Table 1 sets forth the analysis of each of the heats shown on FIG. 3. As seen from FIG. 3, the left-hand curve shown is based on calculated basis for total pressure of partial nitrogen and partial hydrogen equal to 1.0 atmosphere.

TABLE 1

| Last LMF Chems Seq ID | LMF C | LMF Si | LMF Mn | LMF N | LMF S | LMF P | LMF Al | H, ppm |
|---|---|---|---|---|---|---|---|---|
| 822* | 0.0493 | 0.265 | 0.6266 | 0.0075 | 0.011 | 0.0112 | 0.0042 | 7.3 |
| 1019 | 0.049 | 0.282 | 0.6122 | 0.0055 | 0.012 | 0.0113 | 0.0009 | 7 |
| 1057* | 0.0622 | 0.2818 | 0.4894 | 0.008 | 0.013 | 0.0102 | 0.0008 | 8.3 |
| 1060* | 0.0541 | 0.2986 | 0.5642 | 0.0081 | 0.0084 | 0.0107 | 0.0012 | 7.3 |

TABLE 1-continued

| Last LMF Chems Seq ID | LMF C | LMF Si | LMF Mn | LMF N | LMF S | LMF P | LMF Al | H, ppm |
|---|---|---|---|---|---|---|---|---|
| 1071* | 0.0547 | 0.1939 | 0.5616 | 0.0056 | 0.0076 | 0.0088 | 0.0029 | 5.6 |
| 1074* | 0.0504 | 0.2989 | 0.5531 | 0.0042 | 0.0087 | 0.0149 | 0.002 | 6.3 |
| 1078* | 0.0598 | 0.3212 | 0.6165 | 0.0081 | 0.0092 | 0.0155 | 0.0018 | 6.5 |
| 1079 | 0.0572 | 0.3368 | 0.6122 | 0.0067 | 0.0095 | 0.0117 | 0.0014 | 8.9 |
| 1080* | 0.0582 | 0.2508 | 0.5688 | 0.0087 | 0.0119 | 0.011 | 0.0017 | 7.3 |
| 1082* | 0.0606 | 0.2777 | 0.5603 | 0.0084 | 0.0094 | 0.0131 | 0.0016 | 7.4 |
| 1087* | 0.0568 | 0.2794 | 0.5981 | 0.0078 | 0.0067 | 0.0166 | 0.0019 | 8.4 |
| 1088* | 0.0534 | 0.3077 | 0.6044 | 0.0081 | 0.0106 | 0.0155 | 0.0025 | 8.3 |
| 1091 | 0.0479 | 0.2262 | 0.5565 | 0.0084 | 0.0095 | 0.026 | 0.0024 | 9 |
| 1095 | 0.0448 | 0.2343 | 0.5963 | 0.007 | 0.0086 | 0.0072 | 0.0013 | 8.5 |
| 1098* | 0.0567 | 0.3831 | 0.4559 | 0.008 | 0.0119 | 0.0111 | 0.0017 | 7 |
| 1099* | 0.0532 | 0.2718 | 0.5324 | 0.0071 | 0.0109 | 0.0129 | 0.0015 | 6.8 |
| 1100* | 0.0533 | 0.2685 | 0.5658 | 0.0074 | 0.0088 | 0.0108 | 0.0022 | 7.7 |
| 1103* | 0.0548 | 0.2997 | 0.6137 | 0.0071 | 0.0115 | 0.012 | 0.0016 | 7.1 |
| 1104* | 0.054 | 0.2799 | 0.6771 | 0.0067 | 0.008 | 0.0114 | 0.0024 | 7.4 |
| 1106* | 0.047 | 0.3229 | 0.6281 | 0.0058 | 0.01 | 0.0104 | 0.0028 | 7.6 |
| 1110* | 0.0434 | 0.3068 | 0.6848 | 0.0046 | 0.006 | 0.0111 | 0.0014 | 4.4 |
| 1111 | 0.0414 | 0.3002 | 0.5669 | 0.005 | 0.0089 | 0.0163 | 0.0019 | 5.6 |
| 1113* | 0.0289 | 0.0798 | 0.4376 | 0.0044 | 0.0053 | 0.0101 | 0.0182 | 4.6 |
| 1113 | 0.0416 | 0.2212 | 0.5914 | 0.0053 | 0.0067 | 0.0119 | 0.0025 | 6.2 |
| 1114* | 0.0489 | 0.3034 | 0.5943 | 0.0055 | 0.0058 | 0.008 | 0.0017 | 3.9 |
| 1115* | 0.0594 | 0.3404 | 0.6565 | 0.0053 | 0.0064 | 0.0129 | 0.0021 | 4.7 |
| 1116 | 0.0507 | 0.3725 | 0.6806 | 0.0062 | 0.0095 | 0.0123 | 0.0051 | 5 |
| 1117 | 0.0437 | 0.2258 | 0.563 | 0.0067 | 0.008 | 0.0121 | 0.0012 | 5 |
| 1118* | 0.0629 | 0.3149 | 0.633 | 0.0081 | 0.0086 | 0.0143 | 0.001 | 7.7 |
| 1120* | 0.0486 | 0.2935 | 0.5384 | 0.0077 | 0.0063 | 0.0074 | 0.0048 | 7.7 |
| 1121* | 0.0492 | 0.314 | 0.6371 | 0.0073 | 0.0093 | 0.0163 | 0.0012 | 7.9 |
| 1122* | 0.0525 | 0.2639 | 0.5867 | 0.0085 | 0.011 | 0.0141 | 0.0009 | 7.5 |
| 1123 | 0.0578 | 0.3238 | 0.5966 | 0.0058 | 0.0082 | 0.0124 | 0.0023 | 5.2 |
| 1125* | 0.0682 | 0.3221 | 0.5786 | 0.0063 | 0.0055 | 0.0083 | 0.0005 | 4.7 |
| 1128* | 0.0408 | 0.2456 | 0.5895 | 0.005 | 0.0083 | 0.0095 | 0.0016 | 5.1 |
| 1130 | 0.0378 | 0.3219 | 0.627 | 0.0073 | 0.0087 | 0.0172 | 0.0023 | 5.1 |
| 1133 | 0.0398 | 0.2899 | 0.574 | 0.0054 | 0.0084 | 0.0092 | 0.0033 | 5.2 |
| 1134 | 0.0558 | 0.2612 | 0.6039 | 0.0055 | 0.009 | 0.0148 | 0.0038 | 5.9 |
| 1135 | 0.0567 | 0.2085 | 0.6093 | 0.0052 | 0.0125 | 0.0151 | 0.0015 | 4.6 |
| 1144* | 0.0554 | 0.3702 | 0.6315 | 0.0077 | 0.0098 | 0.0108 | 0.0027 | 6.7 |
| 1160* | 0.0448 | 0.3338 | 0.5496 | 0.0054 | 0.0055 | 0.0078 | 0.004 | 4.4 |
| 1161 | 0.057 | 0.3182 | 0.6093 | 0.0054 | 0.0066 | 0.0092 | 0.0015 | 4.2 |
| 1163 | 0.0499 | 0.3198 | 0.6033 | 0.0053 | 0.0056 | 0.0078 | 0.0026 | 4.2 |
| 1164 | 0.0352 | 0.2783 | 0.59 | 0.0058 | 0.0058 | 0.0076 | 0.0025 | 3.6 |
| 1167 | 0.0451 | 0.3395 | 0.6026 | 0.0054 | 0.0073 | 0.0086 | 0.0024 | 3.5 |
| 1168 | 0.0515 | 0.2841 | 0.5897 | 0.0058 | 0.0043 | 0.0059 | 0.0018 | 3.9 |
| 1170 | 0.0366 | 0.2839 | 0.5958 | 0.0062 | 0.0054 | 0.0077 | 0.0018 | 4 |
| 1171 | 0.0454 | 0.304 | 0.586 | 0.007 | 0.0053 | 0.0073 | 0.0031 | 4.7 |
| 1172 | 0.0372 | 0.291 | 0.618 | 0.005 | 0.006 | 0.0087 | 0.0017 | 3.5 |
| 1173 | 0.0537 | 0.3049 | 0.6171 | 0.0051 | 0.0038 | 0.0086 | 0.0014 | 5.2 |
| 1180 | 0.054 | 0.2706 | 0.6285 | 0.0055 | 0.0069 | 0.006 | 0.001 | 4 |
| 1182 | 0.0543 | 0.3296 | 0.6386 | 0.0062 | 0.0082 | 0.0094 | 0.0013 | 4.5 |
| 1182 | 0.0511 | 0.3008 | 0.6025 | 0.0049 | 0.0057 | 0.0099 | 0.0015 | 4.2 |
| 1183 | 0.0549 | 0.2859 | 0.6147 | 0.0069 | 0.0082 | 0.0087 | 0.0003 | 3.7 |
| 1183 | 0.0492 | 0.2718 | 0.6245 | 0.0063 | 0.0054 | 0.0085 | 0.0007 | 3.8 |
| 1188 | 0.0511 | 0.3076 | 0.6298 | 0.0073 | 0.0042 | 0.0076 | 0.0048 | 4.4 |
| 1189 | 0.0562 | 0.3133 | 0.646 | 0.0063 | 0.0031 | 0.0083 | 0.0085 | 3.2 |
| 1189 | 0.0452 | 0.3536 | 0.6902 | 0.0049 | 0.0014 | 0.0079 | 0.0132 | 4.1 |
| 1193* | 0.0556 | 0.2864 | 0.6116 | 0.0059 | 0.0063 | 0.0084 | 0.0017 | 3.7 |
| 1196 | 0.0103 | 0.2989 | 0.6053 | 0.0052 | 0.0018 | 0.0082 | 0.0171 | 4 |
| 1198 | 0.0531 | 0.2643 | 0.6123 | 0.007 | 0.0064 | 0.0079 | 0.003 | 5 |
| 1200* | 0.0534 | 0.2627 | 0.6082 | 0.0078 | 0.0107 | 0.007 | 0.0018 | 6.7 |
| 1205* | 0.0544 | 0.2696 | 0.6037 | 0.0078 | 0.0097 | 0.0063 | 0.0011 | 6.8 |

*indicates reduced Heat Flux Sequences

The composition of all heats in Table 1 are in percent by weight, and are shown in FIG. 3. The heats were measured for a heat flux index of ±0.7 megawatt per square meter from the desired level, i.e., range about a standard heat flux for a given casting speed. Examples of standard heat flux for a given casting speed is 15 megawatts/$m^2$ for a casting speed of 80 meters/min and 13 megawatts/$m^2$ for casting speed of 65 meters/min. Astrerisk heats in Table 1 had the heat flux index within an acceptable range of ±0.7 megawatts pre square meter as shown in FIG. 3. The curve in FIG. 3 shows maximum allowable levels of free nitrogen and free hydrogen for the summed partial pressures of the free nitrogen and free hydrogen totaling 1.0 atmospheres to produce the acceptable heat flux index of ±0.7 megawatts per square meter. As shown in FIG. 3, all of the heats that had a free nitrogen level below about 85 ppm and a free hydrogen level below about 6.5 ppm had a heat flux within the desired range except heats 1110 and 1125. In heat 1110, the free oxygen levels were usually low, approximately 10 ppm, and in heat 1125, there were mechanical problems in the casting equipment.

More recently, additional heats have been made with low nitrogen and low hydrogen having compositions shown in Table 2. The nitrogen level range from 42 to 118 ppm and the hydrogen levels ranged from 3.0 to 6.9 ppm. However, the hydrogen level of 6.9 ppm is with a ferrostatic head of more than 1 atmosphere pressure, namely about 1.15 atmospheres, as shown by the right-hand curve in FIG. 3.

TABLE 2

| SEQ_ID | HEAT_ID | C | MN | N | S | SI | P | AL | H, ppm |
|---|---|---|---|---|---|---|---|---|---|
| 1734 | 248991 | 0.0502 | 0.5653 | 0.0042 | 0.0079 | 0.2615 | 0.0124 | 0.0006 | 4.6 |
| 1705 | 248296 | 0.048 | 0.5767 | 0.0054 | 0.0087 | 0.3154 | 0.017 | 0.0019 | 4.6 |
| 1701 | 142523 | 0.0461 | 0.5798 | 0.0053 | 0.0051 | 0.2729 | 0.0112 | 0.0008 | 5.1 |
| 1696 | 248237 | 0.0513 | 0.5793 | 0.0055 | 0.0052 | 0.2902 | 0.0112 | 0.0014 | 5 |
| 1695 | 248227 | 0.0559 | 0.5701 | 0.0066 | 0.0039 | 0.2436 | 0.0115 | 0.0006 | 6 |
| 1694 | 248207 | 0.0487 | 0.5763 | 0.0059 | 0.0081 | 0.2643 | 0.0172 | 0.0007 | 4.3 |
| 1691 | 248031 | 0.0481 | 0.5851 | 0.0063 | 0.0063 | 0.2605 | 0.0119 | 0.0006 | 4.4 |
| 1690 | 142250 | 0.0507 | 0.5928 | 0.0058 | 0.007 | 0.2582 | 0.0138 | 0.0009 | 3.2 |
| 1690 | 142248 | 0.0554 | 0.5859 | 0.0079 | 0.0057 | 0.2583 | 0.017 | 0.001 | 4.3 |
| 1689 | 248008 | 0.0473 | 0.5747 | 0.0051 | 0.0049 | 0.2631 | 0.014 | 0.0011 | 2.9 |
| 1689 | 248007 | 0.0538 | 0.575 | 0.0056 | 0.0055 | 0.2611 | 0.0127 | 0.0007 | 3.6 |
| 1688 | 248005 | 0.0493 | 0.5802 | 0.0053 | 0.0038 | 0.2629 | 0.0127 | 0.0008 | 4.6 |
| 1687 | 247994 | 0.0467 | 0.5974 | 0.0055 | 0.0045 | 0.2653 | 0.0129 | 0.001 | 3.8 |
| 1687 | 247992 | 0.0497 | 0.5791 | 0.0049 | 0.0056 | 0.2541 | 0.0114 | 0.0009 | 3.7 |
| 1684 | 247975 | 0.0498 | 0.5839 | 0.0061 | 0.0064 | 0.248 | 0.012 | 0.0007 | 3.7 |
| 1684 | 247973 | 0.051 | 0.5716 | 0.0052 | 0.0031 | 0.2743 | 0.0122 | 0.0007 | 4.5 |
| 1683 | 247968 | 0.0488 | 0.5782 | 0.0062 | 0.0067 | 0.2774 | 0.0173 | 0.0008 | 3.9 |
| 1683 | 247965 | 0.0533 | 0.5753 | 0.0069 | 0.0081 | 0.2744 | 0.0183 | 0.0008 | 5 |
| 1681 | 247954 | 0.0532 | 0.5354 | 0.0058 | 0.0061 | 0.2432 | 0.0152 | 0.0017 | 4.1 |
| 1680 | 247934 | 0.0528 | 0.5861 | 0.0051 | 0.0049 | 0.2506 | 0.0106 | 0.0008 | 4.4 |
| 1679 | 247927 | 0.0524 | 0.5325 | 0.0063 | 0.0074 | 0.2521 | 0.0139 | 0.0007 | 4 |
| 1679 | 247925 | 0.0496 | 0.5266 | 0.0063 | 0.0065 | 0.2388 | 0.0121 | 0.0007 | 3.3 |
| 1679 | 247923 | 0.0549 | 0.5395 | 0.0063 | 0.0044 | 0.2354 | 0.0126 | 0.0007 | 4.5 |
| 1678 | 247917 | 0.0562 | 0.572 | 0.0052 | 0.0064 | 0.27 | 0.0156 | 0.0029 | 2.7 |
| 1678 | 247915 | 0.0499 | 0.6139 | 0.0052 | 0.0073 | 0.2789 | 0.0134 | 0.0009 | 3.3 |
| 1677 | 247910 | 0.0543 | 0.5721 | 0.0055 | 0.0088 | 0.2444 | 0.0163 | 0.0008 | 3.3 |
| 1677 | 247907 | 0.0491 | 0.5727 | 0.0076 | 0.008 | 0.2383 | 0.0214 | 0.0004 | 4.6 |
| 1676 | 142129 | 0.0505 | 0.5408 | 0.0061 | 0.0077 | 0.2374 | 0.0161 | 0.0005 | 3.9 |
| 1676 | 247898 | 0.0449 | 0.535 | 0.0052 | 0.0072 | 0.2589 | 0.0156 | 0.0008 | 3.9 |
| 1676 | 247896 | 0.0521 | 0.54 | 0.0071 | 0.0051 | 0.2273 | 0.0139 | 0.0005 | 5.1 |
| 1675 | 247894 | 0.0474 | 0.5398 | 0.006 | 0.0082 | 0.2442 | 0.0173 | 0.0005 | 3.3 |
| 1675 | 247892 | 0.0476 | 0.5845 | 0.0062 | 0.0092 | 0.2641 | 0.0215 | 0.0007 | 4.1 |
| 1674 | 247886 | 0.0518 | 0.6002 | 0.0061 | 0.0087 | 0.2544 | 0.0178 | 0.0022 | 3.3 |
| 1674 | 247884 | 0.0538 | 0.5682 | 0.0062 | 0.0081 | 0.2553 | 0.0164 | 0.0015 | 4 |
| 1673 | 142103 | 0.0471 | 0.5582 | 0.007 | 0.0063 | 0.2293 | 0.0207 | 0.003 | 4.1 |
| 1673 | 247874 | 0.0516 | 0.5262 | 0.0062 | 0.0049 | 0.2469 | 0.0161 | 0.0007 | 5.4 |
| 1672 | 247871 | 0.0533 | 0.5458 | 0.007 | 0.0057 | 0.2457 | 0.0216 | 0.0009 | 4.4 |
| 1672 | 247869 | 0.0478 | 0.554 | 0.0063 | 0.0059 | 0.2095 | 0.0242 | 0.0012 | 5.2 |
| 1671 | 247859 | 0.049 | 0.5848 | 0.0059 | 0.0051 | 0.2666 | 0.0108 | 0.0005 | 5 |
| 1670 | 247848 | 0.0505 | 0.5728 | 0.0064 | 0.0062 | 0.2402 | 0.0207 | 0.0007 | 4.7 |
| 1667 | 247817 | 0.0468 | 0.5921 | 0.0052 | 0.0059 | 0.268 | 0.0141 | 0.0013 | 3.5 |
| 1662 | 247612 | 0.0495 | 0.5773 | 0.0072 | 0.0075 | 0.2548 | 0.018 | 0.001 | 5.6 |
| 1657 | 247525 | 0.048 | 0.57 | 0.0068 | 0.004 | 0.257 | 0.019 | 0 | 4.8 |
| 1657 | 247524 | 0.051 | 0.58 | 0.0077 | 0.004 | 0.246 | 0.016 | 0 | 5.8 |
| 1656 | 247515 | 0.0491 | 0.5768 | 0.0052 | 0.0076 | 0.2457 | 0.0115 | 0.0007 | 3.3 |
| 1656 | 247513 | 0.0496 | 0.5965 | 0.0053 | 0.0064 | 0.2916 | 0.0092 | 0.0008 | 4.2 |
| 1655 | 247507 | 0.0463 | 0.5777 | 0.0058 | 0.0093 | 0.2608 | 0.0117 | 0.0005 | 4.3 |
| 1655 | 247505 | 0.0503 | 0.5691 | 0.0053 | 0.0061 | 0.2403 | 0.0173 | 0.0008 | 6.9 |
| 1654 | 247490 | 0.0541 | 0.5753 | 0.0065 | 0.0064 | 0.2533 | 0.0094 | 0.001 | 4.2 |
| 1652 | 247484 | 0.0496 | 0.5877 | 0.0064 | 0.0064 | 0.251 | 0.0139 | 0.0009 | 5.3 |
| 1651 | 141683 | 0.0566 | 0.6004 | 0.0058 | 0.0061 | 0.2698 | 0.0094 | 0.0008 | 4.7 |
| 1650 | 247461 | 0.0467 | 0.5729 | 0.006 | 0.0038 | 0.2663 | 0.0095 | 0.001 | 4.2 |
| 1650 | 141675 | 0.0519 | 0.5787 | 0.006 | 0.0052 | 0.2629 | 0.0098 | 0.0013 | 5 |
| 1649 | 141666 | 0.0546 | 0.6045 | 0.0056 | 0.0065 | 0.2755 | 0.0108 | 0.0009 | 4.2 |
| 1648 | 247441 | 0.0502 | 0.5949 | 0.0057 | 0.0049 | 0.2708 | 0.0097 | 0.0008 | 3.4 |
| 1648 | 247439 | 0.0493 | 0.5818 | 0.0047 | 0.0079 | 0.2588 | 0.012 | 0.0008 | 4.2 |
| 1647 | 247430 | 0.0483 | 0.5972 | 0.006 | 0.0037 | 0.2643 | 0.0069 | 0.0012 | 4.2 |
| 1646 | 141641 | 0.0497 | 0.5954 | 0.0044 | 0.0054 | 0.3043 | 0.0062 | 0.0011 | 3.6 |
| 1645 | 247410 | 0.0482 | 0.5731 | 0.0051 | 0.008 | 0.2456 | 0.0083 | 0.0007 | 3.8 |
| 1644 | 247403 | 0.05 | 0.6043 | 0.0065 | 0.0053 | 0.2547 | 0.0073 | 0.0007 | 4.2 |
| 1643 | 247399 | 0.0536 | 0.5801 | 0.0061 | 0.0054 | 0.2433 | 0.0075 | 0.0012 | 4.9 |
| 1642 | 247392 | 0.0531 | 0.5978 | 0.005 | 0.0056 | 0.2651 | 0.009 | 0.001 | 3.5 |
| 1642 | 247390 | 0.0499 | 0.5788 | 0.005 | 0.0066 | 0.2669 | 0.0077 | 0.0008 | 3.1 |
| 1640 | 247377 | 0.0519 | 0.5601 | 0.0055 | 0.0085 | 0.2511 | 0.0099 | 0.0026 | 3.7 |
| 1639 | 247362 | 0.0507 | 0.5192 | 0.0069 | 0.0054 | 0.2132 | 0.0096 | 0.0005 | 3.7 |
| 1639 | 247360 | 0.0492 | 0.5146 | 0.006 | 0.0058 | 0.1896 | 0.0094 | 0.0004 | 4.5 |
| 1638 | 247352 | 0.0492 | 0.587 | 0.0065 | 0.0084 | 0.2734 | 0.009 | 0.0006 | 3.7 |
| 1638 | 141578 | 0.0517 | 0.5727 | 0.0067 | 0.0111 | 0.2632 | 0.0155 | 0.0006 | 4.5 |
| 1637 | 247337 | 0.0484 | 0.5415 | 0.0059 | 0.0069 | 0.2201 | 0.0115 | 0.0006 | 4.4 |
| 1637 | 247335 | 0.0531 | 0.5491 | 0.0068 | 0.0076 | 0.2374 | 0.0102 | 0.0009 | 4.5 |

TABLE 2-continued

| SEQ_ID | HEAT_ID | C | MN | N | S | SI | P | AL | H, ppm |
|---|---|---|---|---|---|---|---|---|---|
| 1636 | 141557 | 0.0504 | 0.5592 | 0.0076 | 0.0087 | 0.2491 | 0.0114 | 0.0005 | 4.4 |
| 1634 | 247319 | 0.049 | 0.5424 | 0.0071 | 0.007 | 0.2094 | 0.0111 | 0.0003 | 4.6 |
| 1633 | 247310 | 0.0486 | 0.59 | 0.006 | 0.0089 | 0.2655 | 0.0098 | 0.0002 | 4.1 |
| 1632 | 247133 | 0.0519 | 0.5795 | 0.0067 | 0.005 | 0.2511 | 0.0093 | 0.0006 | 3.9 |
| 1632 | 247130 | 0.0461 | 0.5733 | 0.0058 | 0.0043 | 0.2421 | 0.0091 | 0.0004 | 4 |
| 1631 | 141348 | 0.0505 | 0.575 | 0.0057 | 0.0047 | 0.2434 | 0.0087 | 0.0007 | 3.5 |
| 1631 | 141347 | 0.0463 | 0.5886 | 0.0056 | 0.0065 | 0.2798 | 0.0098 | 0.0006 | 3.9 |
| 1630 | 341342 | 0.0521 | 0.5775 | 0.0075 | 0.0077 | 0.2387 | 0.0133 | 0.0005 | 4.6 |
| 1624 | 141300 | 0.0456 | 0.5921 | 0.005 | 0.0068 | 0.2586 | 0.0086 | 0.0006 | 4 |
| 1623 | 141288 | 0.051 | 0.5978 | 0.0055 | 0.0064 | 0.2766 | 0.0107 | 0.0012 | 3.5 |
| 1621 | 247048 | 0.047 | 0.5613 | 0.0043 | 0.0066 | 0.2423 | 0.0112 | 0.0005 | 3.5 |
| 1621 | 247046 | 0.0499 | 0.553 | 0.0048 | 0.0062 | 0.2546 | 0.0105 | 0.0006 | 3.9 |
| 1620 | 247036 | 0.0531 | 0.5953 | 0.0053 | 0.0087 | 0.2463 | 0.0104 | 0.0008 | 3.5 |
| 1619 | 141253 | 0.0506 | 0.5932 | 0.005 | 0.007 | 0.2589 | 0.0152 | 0.0011 | 3.6 |
| 1619 | 141252 | 0.0485 | 0.5782 | 0.0064 | 0.0085 | 0.2363 | 0.0133 | 0.001 | 3.9 |
| 1618 | 247018 | 0.0532 | 0.589 | 0.0057 | 0.0077 | 0.2359 | 0.0104 | 0.0004 | 4.3 |
| 1617 | 247011 | 0.0457 | 0.5767 | 0.0051 | 0.0053 | 0.2647 | 0.0105 | 0.001 | 3.3 |
| 1616 | 246997 | 0.0521 | 0.6192 | 0.0118 | 0.0044 | 0.2344 | 0.0072 | 0.0007 | 3.3 |
| 1611 | 246957 | 0.0533 | 0.574 | 0.0076 | 0.0078 | 0.2251 | 0.0151 | 0.0004 | 4.2 |
| 1610 | 246942 | 0.0469 | 0.5853 | 0.0063 | 0.0085 | 0.2698 | 0.011 | 0.0007 | 3.3 |
| 1610 | 246940 | 0.0535 | 0.5926 | 0.0063 | 0.0081 | 0.2533 | 0.0093 | 0.0006 | 4 |
| 1609 | 141146 | 0.0529 | 0.5733 | 0.0054 | 0.0073 | 0.223 | 0.0101 | 0.0007 | 3.4 |
| 1609 | 141141 | 0.0547 | 0.5534 | 0.0069 | 0.009 | 0.2169 | 0.0093 | 0.0005 | 4 |
| 1608 | 246915 | 0.0489 | 0.5895 | 0.006 | 0.007 | 0.2751 | 0.0093 | 0.0008 | 3.4 |
| 1607 | 141117 | 0.0537 | 0.5756 | 0.007 | 0.0077 | 0.2419 | 0.0122 | 0.0007 | 3.4 |
| 1606 | 141097 | 0.0512 | 0.5936 | 0.0057 | 0.0065 | 0.2582 | 0.0115 | 0.0005 | 3.6 |
| 1605 | 246877 | 0.0527 | 0.6154 | 0.0078 | 0.0056 | 0.2507 | 0.0092 | 0.0009 | 3.5 |
| 1605 | 246879 | 0.0497 | 0.5939 | 0.0055 | 0.0072 | 0.2418 | 0.0124 | 0.0009 | 3.1 |
| 1604 | 246862 | 0.0483 | 0.6336 | 0.0053 | 0.006 | 0.2694 | 0.0088 | 0.001 | 4.6 |
| 1603 | 246854 | 0.0522 | 0.6157 | 0.0058 | 0.0069 | 0.2587 | 0.0103 | 0.0011 | 3.2 |
| 1603 | 246852 | 0.0536 | 0.5455 | 0.005 | 0.0057 | 0.2468 | 0.01 | 0.0011 | 3.8 |
| 1602 | 246836 | 0.0468 | 0.6049 | 0.0044 | 0.0062 | 0.2748 | 0.0109 | 0.001 | 4.6 |
| 1601 | 246824 | 0.052 | 0.5846 | 0.0044 | 0.0103 | 0.2392 | 0.0126 | 0.0004 | 4.8 |
| 1598 | 246806 | 0.0459 | 0.5803 | 0.0041 | 0.006 | 0.2684 | 0.0086 | 0.0006 | 4.4 |
| 1598 | 246804 | 0.0499 | 0.5795 | 0.0053 | 0.0077 | 0.2609 | 0.011 | 0.0005 | 5.2 |
| 1597 | 141011 | 0.044 | 0.5661 | 0.0061 | 0.0063 | 0.2635 | 0.0125 | 0.0006 | 5.3 |
| 1596 | 246777 | 0.0492 | 0.5378 | 0.0072 | 0.0052 | 0.2417 | 0.0115 | 0.0003 | 4.5 |
| 1595 | 140990 | 0.0428 | 0.5817 | 0.0053 | 0.0036 | 0.2529 | 0.0131 | 0.0009 | 4.3 |
| 1595 | 140988 | 0.0494 | 0.5583 | 0.0072 | 0.0071 | 0.2074 | 0.0107 | 0.0004 | 4.6 |
| 1594 | 246759 | 0.048 | 0.5355 | 0.0064 | 0.009 | 0.2218 | 0.0094 | 0.0005 | 5.1 |
| 1594 | 140978 | 0.0479 | 0.5645 | 0.0065 | 0.0068 | 0.228 | 0.0157 | 0.0005 | 5.6 |
| 1593 | 140976 | 0.0541 | 0.5799 | 0.0066 | 0.0074 | 0.2485 | 0.0143 | 0.001 | 4.5 |
| 1592 | 246741 | 0.047 | 0.5652 | 0.0053 | 0.0055 | 0.2348 | 0.0127 | 0.0009 | 4.9 |
| 1591 | 246739 | 0.0549 | 0.5755 | 0.0075 | 0.0041 | 0.2343 | 0.016 | 0.001 | 4.6 |
| 1590 | 246725 | 0.0404 | 0.575 | 0.0045 | 0.0079 | 0.2505 | 0.0109 | 0.0002 | 4 |
| 1589 | 140941 | 0.0524 | 0.5793 | 0.0053 | 0.0057 | 0.2414 | 0.0127 | 0.0011 | 4.9 |
| 1588 | 246565 | 0.0477 | 0.6328 | 0.0078 | 0.0065 | 0.2361 | 0.0166 | 0.0012 | 4 |
| 1587 | 246559 | 0.0457 | 0.5635 | 0.0055 | 0.0055 | 0.2446 | 0.0218 | 0.0002 | 3.8 |
| 1586 | 246546 | 0.0573 | 0.5793 | 0.0059 | 0.0094 | 0.2237 | 0.0134 | 0.0003 | 3.4 |
| 1585 | 246544 | 0.0601 | 0.5434 | 0.007 | 0.0067 | 0.2672 | 0.0198 | 0.001 | 3.5 |
| 1584 | 246536 | 0.0538 | 0.5664 | 0.0064 | 0.0061 | 0.2087 | 0.0161 | 0.0008 | 3.8 |
| 1584 | 246528 | 0.0488 | 0.559 | 0.0061 | 0.0051 | 0.2251 | 0.0166 | 0.0009 | 4.8 |
| 1583 | 246527 | 0.0519 | 0.5723 | 0.0067 | 0.0082 | 0.2173 | 0.0123 | 0.0007 | 4 |
| 1582 | 246520 | 0.0485 | 0.582 | 0.0058 | 0.0108 | 0.2435 | 0.0137 | 0.0008 | 3.6 |
| 1582 | 246518 | 0.052 | 0.5639 | 0.0068 | 0.0104 | 0.2441 | 0.0121 | 0.0005 | 3.8 |
| 1579 | 246481 | 0.0514 | 0.5968 | 0.0063 | 0.0058 | 0.2555 | 0.0135 | 0.0007 | 3.3 |
| 1577 | 246459 | 0.0496 | 0.5945 | 0.0055 | 0.0056 | 0.2538 | 0.017 | 0.0005 | 3.1 |
| 1577 | 246457 | 0.0488 | 0.5943 | 0.006 | 0.0044 | 0.249 | 0.0156 | 0.0007 | 3.4 |
| 1576 | 246445 | 0.0446 | 0.549 | 0.0054 | 0.0031 | 0.2429 | 0.0105 | 0.0003 | 3.1 |
| 1575 | 246439 | 0.0498 | 0.5975 | 0.0049 | 0.0054 | 0.2644 | 0.0142 | 0.0006 | 3.2 |
| 1573 | 246414 | 0.0514 | 0.606 | 0.0047 | 0.0081 | 0.2639 | 0.0108 | 0.0005 | 3.2 |
| 1573 | 246412 | 0.0475 | 0.5915 | 0.0043 | 0.006 | 0.2657 | 0.0144 | 0.0006 | 3.8 |
| 1572 | 246393 | 0.0475 | 0.5955 | 0.0061 | 0.0072 | 0.2398 | 0.0113 | 0.0005 | 4.3 |
| 1570 | 246382 | 0.0501 | 0.5498 | 0.006 | 0.0071 | 0.2495 | 0.0122 | 0.0005 | 4.3 |
| 1569 | 246367 | 0.0563 | 0.5763 | 0.006 | 0.0064 | 0.2326 | 0.0108 | 0.0006 | 3.4 |
| 1569 | 246365 | 0.0501 | 0.5745 | 0.006 | 0.0063 | 0.229 | 0.0127 | 0.0003 | 3.6 |
| 1568 | 246356 | 0.0486 | 0.5478 | 0.0058 | 0.0082 | 0.2374 | 0.0129 | 0.0026 | 3 |
| 1568 | 246354 | 0.0499 | 0.5564 | 0.0062 | 0.0078 | 0.2437 | 0.013 | 0.0013 | 3.3 |
| 1567 | 246341 | 0.0489 | 0.5659 | 0.006 | 0.0083 | 0.2291 | 0.0153 | 0.0002 | 3.3 |
| 1567 | 140568 | 0.0469 | 0.539 | 0.0061 | 0.0069 | 0.2159 | 0.0137 | 0.0004 | 3.5 |
| 1566 | 246331 | 0.0452 | 0.5614 | 0.0051 | 0.0086 | 0.2491 | 0.0129 | 0 | 2.7 |
| 1566 | 246329 | 0.0433 | 0.5522 | 0.0054 | 0.0072 | 0.2514 | 0.0124 | 0.0006 | 3.4 |
| 1565 | 246318 | 0.0504 | 0.5674 | 0.0047 | 0.0068 | 0.241 | 0.0115 | 0 | 3.8 |
| 1564 | 246304 | 0.0483 | 0.5708 | 0.0038 | 0.0077 | 0.2519 | 0.0119 | 0 | 3.1 |
| 1564 | 246302 | 0.0502 | 0.5742 | 0.005 | 0.0073 | 0.2563 | 0.0121 | 0.0002 | 3.5 |
| 1563 | 140529 | 0.0537 | 0.582 | 0.0066 | 0.0061 | 0.2574 | 0.0131 | 0 | 3.6 |
| 1561 | 140516 | 0.0546 | 0.5888 | 0.0048 | 0.006 | 0.2504 | 0.014 | 0 | 3.7 |

TABLE 2-continued

| SEQ_ID | HEAT_ID | C | MN | N | S | SI | P | AL | H, ppm |
|---|---|---|---|---|---|---|---|---|---|
| 1561 | 246272 | 0.0495 | 0.5774 | 0.0051 | 0.0051 | 0.2423 | 0.0142 | 0 | 3.9 |
| 1560 | 140502 | 0.0497 | 0.5865 | 0.005 | 0.0061 | 0.2626 | 0.0122 | 0.0004 | 3.2 |
| 1560 | 140500 | 0.0494 | 0.5902 | 0.0051 | 0.0037 | 0.2591 | 0.0154 | 0.0001 | 3.9 |
| 1558 | 246242 | 0.0479 | 0.6095 | 0.005 | 0.005 | 0.2586 | 0.0127 | 0.0006 | 3.9 |
| 1558 | 246240 | 0.0472 | 0.5867 | 0.0052 | 0.008 | 0.245 | 0.0107 | 0.0004 | 4.5 |
| 1556 | 246020 | 0.0522 | 0.607 | 0.0062 | 0.0077 | 0.2674 | 0.0085 | 0.0006 | 3.6 |
| 1555 | 140256 | 0.0554 | 0.5559 | 0.0061 | 0.0059 | 0.2504 | 0.0107 | 0.0003 | 4.3 |
| 1551 | 245974 | 0.0539 | 0.5876 | 0.0077 | 0.0064 | 0.2776 | 0.0128 | 0 | 4 |
| 1550 | 245965 | 0.0556 | 0.5781 | 0.0078 | 0.0054 | 0.2545 | 0.0127 | 0 | 3.9 |
| 1550 | 245963 | 0.0513 | 0.5759 | 0.0074 | 0.0057 | 0.2686 | 0.0131 | 0 | 4 |
| 1549 | 245948 | 0.0549 | 0.5936 | 0.0075 | 0.0069 | 0.2493 | 0.0118 | 0.0002 | 3.6 |
| 1548 | 245938 | 0.0528 | 0.6059 | 0.0064 | 0.0059 | 0.273 | 0.0142 | 0.0002 | 3.7 |
| 1548 | 245936 | 0.0525 | 0.602 | 0.0067 | 0.0051 | 0.2828 | 0.0145 | 0.0001 | 3.7 |
| 1547 | 245925 | 0.0516 | 0.585 | 0.0069 | 0.0061 | 0.2543 | 0.0163 | 0.0003 | 3.4 |
| 1547 | 445923 | 0.0593 | 0.5902 | 0.0087 | 0.0087 | 0.244 | 0.0195 | 0.0004 | 3.6 |
| 1545 | 245912 | 0.0509 | 0.567 | 0.0061 | 0.0076 | 0.2583 | 0.0171 | 0.0004 | 3.9 |
| 1544 | 245900 | 0.0535 | 0.5995 | 0.0055 | 0.0085 | 0.2546 | 0.0124 | 0.0007 | 3.4 |
| 1544 | 245898 | 0.0468 | 0.5968 | 0.0058 | 0.0086 | 0.2499 | 0.0143 | 0.001 | 3.4 |
| 1543 | 140119 | 0.0492 | 0.5673 | 0.0062 | 0.0081 | 0.2386 | 0.0093 | 0 | 4.9 |
| 1540 | 245864 | 0.0518 | 0.5756 | 0.0054 | 0.009 | 0.2595 | 0.0163 | 0.0004 | 3.6 |
| 1540 | 245863 | 0.0499 | 0.569 | 0.0055 | 0.0087 | 0.2646 | 0.015 | 0.0002 | 3.9 |
| 1539 | 245850 | 0.0544 | 0.5864 | 0.005 | 0.0082 | 0.2566 | 0.0125 | 0.0005 | 3.7 |
| 1538 | 245837 | 0.0542 | 0.5554 | 0.0057 | 0.007 | 0.2291 | 0.012 | 0.0002 | 4 |
| 1537 | 245825 | 0.0522 | 0.5892 | 0.0052 | 0.0051 | 0.2694 | 0.0098 | 0.0005 | 2.9 |
| 1537 | 245824 | 0.0505 | 0.5761 | 0.006 | 0.0065 | 0.2778 | 0.0134 | 0.0004 | 3.4 |
| 1536 | 140056 | 0.0512 | 0.5926 | 0.0065 | 0.0087 | 0.2416 | 0.0125 | 0.0002 | 3.5 |
| 1536 | 245814 | 0.0578 | 0.5835 | 0.0064 | 0.0098 | 0.2492 | 0.0121 | 0.0002 | 3.7 |
| 1535 | 140039 | 0.0492 | 0.5748 | 0.0072 | 0.0088 | 0.2393 | 0.012 | 0.0003 | 3.8 |
| 1535 | 245797 | 0.0507 | 0.5567 | 0.0075 | 0.0087 | 0.2404 | 0.0113 | 0.0003 | 4.1 |
| 1534 | 245789 | 0.0504 | 0.5519 | 0.0047 | 0.0068 | 0.2903 | 0.017 | 0.0007 | 2.9 |
| 1534 | 245788 | 0.0521 | 0.5839 | 0.0062 | 0.0048 | 0.2573 | 0.0152 | 0.0007 | 3.9 |
| 1533 | 245772 | 0.0539 | 0.5858 | 0.0067 | 0.0087 | 0.2602 | 0.014 | 0.0004 | 3.2 |
| 1533 | 245771 | 0.0557 | 0.5708 | 0.0069 | 0.0085 | 0.258 | 0.0143 | 0.0008 | 4.1 |
| 1532 | 245769 | 0.0483 | 0.5726 | 0.0055 | 0.0073 | 0.2318 | 0.0143 | 0.0001 | 3.6 |
| 1532 | 245767 | 0.0571 | 0.5644 | 0.0052 | 0.0059 | 0.2327 | 0.0137 | 0 | 3.8 |
| 1530 | 245559 | 0.0488 | 0.562 | 0.005 | 0.0043 | 0.2397 | 0.0191 | 0.0005 | 3.2 |
| 1529 | 245553 | 0.0541 | 0.6186 | 0.0072 | 0.009 | 0.2555 | 0.019 | 0.0004 | 3.7 |
| 1528 | 245541 | 0.0507 | 0.5565 | 0.0066 | 0.0102 | 0.2477 | 0.0177 | 0.0003 | 3 |
| 1528 | 245539 | 0.048 | 0.5393 | 0.0068 | 0.0096 | 0.2412 | 0.0178 | 0.0003 | 4.2 |
| 1527 | 245525 | 0.0557 | 0.5628 | 0.0062 | 0.0058 | 0.2499 | 0.0141 | 0.0004 | 3.6 |
| 1527 | 149763 | 0.0526 | 0.5941 | 0.0081 | 0.0072 | 0.2513 | 0.0154 | 0.0005 | 4.4 |
| 1522 | 245462 | 0.0456 | 0.6022 | 0.005 | 0.0068 | 0.2665 | 0.0143 | 0.0006 | 2.9 |
| 1522 | 245461 | 0.0501 | 0.5844 | 0.0058 | 0.0077 | 0.2664 | 0.0153 | 0.0003 | 3.3 |
| 1521 | 149689 | 0.0478 | 0.6002 | 0.0054 | 0.0089 | 0.2797 | 0.0123 | 0.0005 | 3.6 |
| 1520 | 245443 | 0.0478 | 0.5367 | 0.0063 | 0.0064 | 0.2345 | 0.0173 | 0.0004 | 3.6 |
| 1517 | 245424 | 0.0541 | 0.5914 | 0.0071 | 0.0062 | 0.2368 | 0.0115 | 0.0003 | 3.7 |
| 1515 | 149635 | 0.051 | 0.6086 | 0.0064 | 0.0076 | 0.2751 | 0.0119 | 0.0004 | 3.5 |
| 1515 | 149634 | 0.0549 | 0.6079 | 0.0065 | 0.0033 | 0.2653 | 0.0116 | 0.0004 | 3.5 |
| 1514 | 245403 | 0.0491 | 0.5964 | 0.0071 | 0.0085 | 0.2261 | 0.0097 | 0.0001 | 3.5 |
| 1514 | 245400 | 0.051 | 0.5616 | 0.0064 | 0.0087 | 0.2517 | 0.0109 | 0.0001 | 3.9 |
| 1513 | 149612 | 0.0448 | 0.5826 | 0.0057 | 0.0068 | 0.2585 | 0.0147 | 0.0004 | 3.2 |
| 1513 | 149610 | 0.0537 | 0.5647 | 0.0066 | 0.0082 | 0.2466 | 0.0136 | 0 | 3.5 |
| 1512 | 245373 | 0.051 | 0.5857 | 0.0058 | 0.0086 | 0.2512 | 0.0117 | 0.0005 | 2.8 |
| 1512 | 245371 | 0.0507 | 0.5571 | 0.0071 | 0.0075 | 0.2447 | 0.0117 | 0 | 4 |
| 1511 | 245353 | 0.0498 | 0.5823 | 0.0065 | 0.0063 | 0.2387 | 0.0109 | 0.0001 | 3.5 |
| 1510 | 245352 | 0.0532 | 0.5931 | 0.0065 | 0.0063 | 0.2623 | 0.0112 | 0.0001 | 3.8 |
| 1509 | 245339 | 0.0504 | 0.564 | 0.0074 | 0.0089 | 0.2599 | 0.0137 | 0.0003 | 2.9 |
| 1508 | 245333 | 0.0561 | 0.591 | 0.0071 | 0.0073 | 0.2541 | 0.0119 | 0.0003 | 3.6 |
| 1507 | 245308 | 0.0514 | 0.5784 | 0.0053 | 0.0046 | 0.2385 | 0.0118 | 0.0001 | 3.6 |
| 1506 | 245295 | 0.0456 | 0.5876 | 0.0053 | 0.005 | 0.2488 | 0.0095 | 0.0004 | 3.6 |
| 1506 | 245294 | 0.0521 | 0.6418 | 0.006 | 0.0063 | 0.2718 | 0.0116 | 0.0005 | 2.9 |
| 1504 | 245287 | 0.0524 | 0.5863 | 0.0055 | 0.0042 | 0.2609 | 0.0127 | 0.0012 | 3.6 |
| 1503 | 245274 | 0.044 | 0.5684 | 0.0053 | 0.0068 | 0.2509 | 0.0096 | 0.0002 | 3.1 |
| 1503 | 149504 | 0.0485 | 0.5695 | 0.0057 | 0.0066 | 0.2449 | 0.0097 | 0.0002 | 3.5 |
| 1502 | 245262 | 0.0512 | 0.5974 | 0.004 | 0.0088 | 0.269 | 0.0091 | 0.0002 | 2.8 |
| 1502 | 245261 | 0.0475 | 0.579 | 0.0045 | 0.0068 | 0.256 | 0.0107 | 0.0008 | 4 |
| 1500 | 245082 | 0.052 | 0.5876 | 0.0062 | 0.0106 | 0.2418 | 0.0107 | 0.0003 | 2.7 |

From the heats reported in Table 2, it is seen that the levels of nitrogen can be up to 120 ppm, and the levels of hydrogen are between 1.0, 2.0 or 3.0 and 6.5 ppm at atmospheric pressure. Moreover, the hydrogen level of 6.9 ppm in heat 1655 is with ferrostatic head of more than 1 atmosphere pressure, namely about 1.15 atmospheres, as shown in FIG. 3.

The free nitrogen was determined by analysis with optical emission specometry ("OES") calibrated against the thermal conductivity ("TC") method on a scheduled basis. Optical emission spectrometry (OES) using arc and spark excitation is the preferred method to determine the chemical composition of metallic samples. This process is widely used in the metal making industries, including primary producers, foundries, die casters and manufacturing. Due to its rapid analysis time and inherent accuracy, Arc/Spark OES systems are most effective in controlling the processing of alloys. These spectrometers may be used for many aspects of the production cycle including in-coming inspection of materials, metal processing, quality control of semi-finished and finished goods and many other applications where a chemical composition of the metallic material is required.

The Thermal Conductivity (TC) method, used to calibrate the OES, typically employs a microprocessor-based, software controlled instrument that can measure nitrogen, as well as oxygen, in a wide variety of metals, refractories and other inorganic materials. The TC method employs the inert gas fusion principle. A weighed sample, placed in a high purity graphite crucible, is fused under a flowing helium gas stream at temperatures sufficient to release oxygen, nitrogen and hydrogen. The oxygen in the sample, in all forms present, combines with the carbon from the crucible to form carbon monoxide. The nitrogen present in the sample releases as molecular nitrogen and any hydrogen is released as hydrogen gas.

In the TC method, oxygen is measured by infrared absorption (IR). Sample gases first enter the IR module and pass through CO and $CO_2$ detectors. Oxygen present as either CO or $CO_2$ is detected. Following this, sample gas is passed through heated rare-earth copper oxide to convert CO to $CO_2$ and any hydrogen to water. Gases then re-enter the IR module and pass through a separate $CO_2$ detector for total oxygen measurement. This configuration maximizes performance and accuracy for both low and high range.

In the TC method, nitrogen is measured by passing sample gases to be measured through heated rare-earth copper oxide which converts CO to $CO_2$ and hydrogen to water. $CO_2$ and water are then removed to prevent detection by the TC cell. Gas flow then passes through the TC cell for nitrogen detection.

As stated above, the free hydrogen is measured by a Hydrogen Direct Reading Immersed System ("Hydris") unit, made by Hereaus Electronite. This unit is believed to be described in the following referenced US patents: U.S. Pat. Nos. 4,998,432; 5,518,931 and 5,820,745.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. Additional features of the invention will become apparent to those skilled in the art upon consideration of the description. Modifications may be made without departing from the spirit and scope of the invention.

What is claimed is:

1. A method of casting steel strip comprising:

introducing molten plain carbon steel on casting surfaces of at least one casting roll with the molten steel having a free nitrogen content below about 120 ppm and a free hydrogen content below about 6.9 ppm and such that the sum of partial pressure of nitrogen and partial pressure of hydrogen is no more than 1.15 atmospheres;

forming a casting pool of molten metal on the casting surfaces of the casting rolls; and solidifying the molten steel to form metal shells on the casting rolls having nitrogen and hydrogen levels reflected by the content thereof in the molten steel to form thin steel strip.

2. The method of claim 1 where the free hydrogen content is between 1.0 and 6.5 ppm.

3. The method of claim 1 where the sum of partial pressure of nitrogen and partial pressure of hydrogen in the introduced molten metal is no more than 1.0 atmosphere.

4. A method of casting steel strip comprising:

assembling a pair of cooled casting rolls having a nip between them and confining end closures adjacent to ends of the casting rolls;

introducing molten plain carbon steel between the pair of casting rolls to form a casting pool on the casting rolls with the end closures confining the pool, with the molten steel having a free nitrogen content below about 120 ppm and a free hydrogen content below about 6.9 ppm and such that the sum of partial pressure of nitrogen and partial pressure of hydrogen is no more than 1.15 atmospheres;

counter-rotating the casting rolls and solidifying the molten steel to form metal shells on casting surfaces of the casting rolls having nitrogen and hydrogen levels reflected by the content of the molten steel to provide for the formation of thin steel strip; and forming solidified thin steel strip through the nip between the casting rolls to produce a solidified steel strip delivered downwardly from the nip.

5. The method of claim 4 where the sum of partial pressure of nitrogen and partial pressure of hydrogen in the introduced molten metal is no more than 1.0 atmosphere.

6. The method of claim 4 where the free hydrogen content is between 1.0 and 6.5 ppm.

7. A method of casting steel strip comprising:

introducing molten plain carbon steel on casting surfaces of at least one casting roll with the molten steel having a free nitrogen content below about 100 ppm and a free hydrogen content below about 6.9 ppm and such that the sum of partial pressure of nitrogen and partial pressure of hydrogen is no more than 1.15 atmospheres;

forming a casting pool of molten metal on the casting surfaces of the casting rolls; and solidifying the molten steel to form metal shells on the casting rolls having nitrogen and hydrogen levels reflected by the content thereof in the molten steel to form thin steel strip.

8. The method of claim 7 where the free hydrogen content is between 1.0 and 6.5 ppm.

9. A method of casting steel strip comprising:

assembling a pair of cooled casting rolls having a nip between them and confining end closures adjacent to ends of the casting rolls;

introducing molten plain carbon steel between the pair of casting rolls to form a casting pool on the casting rolls with the end closures confining the pool, with the molten steel having a free nitrogen content below about 100 ppm and a free hydrogen content below about 6.9 ppm and such that the sum of partial pressure of nitrogen and partial pressure of hydrogen is no more than 1.15 atmospheres;

counter-rotating the casting rolls and solidifying the molten steel to form metal shells on casting surfaces of the casting rolls having nitrogen and hydrogen levels reflected by the content of the molten steel to provide for the formation of thin steel strip; and forming solidified thin steel strip through the nip between the casting rolls to produce a solidified steel strip delivered downwardly from the nip.

10. The method of claim 9 where the free hydrogen content is between 1.0 and 6.5 ppm.

11. The method of claim 9 where the sum of partial pressure of nitrogen and partial pressure of hydrogen in the introduced molten metal is no more than 1.0 atmosphere.

12. A method of casting steel strip comprising:

introducing molten plain carbon steel on casting surfaces of at least one casting roll with the molten steel having a free nitrogen content below about 85 ppm and a free hydrogen content below about 6.9 ppm measured and such that the sum of partial pressure of nitrogen and partial pressure of hydrogen is no more than 1.15 atmospheres;

forming a casting pool of molten metal on the casting surfaces of the casting rolls; and solidifying the molten steel to form metal shells on the casting rolls having nitrogen and hydrogen levels reflected by the content thereof in the molten steel to form thin steel strip.

13. The method of claim 12 where the free hydrogen content is between 1.0 and 6.5 ppm.

14. A method of casting steel strip comprising:

assembling a pair of cooled casting rolls having a nip between them and confining end closures adjacent to ends of the casting rolls;

introducing molten plain carbon steel between the pair of casting rolls to form a casting pool on the casting rolls with the end closures confining the pool, with the molten steel having a free nitrogen content below about 85 ppm and a free hydrogen content below about 6.9 ppm and such that the sum of partial pressure of nitrogen and partial pressure of hydrogen is no more than 1.15 atmospheres;

counter-rotating the casting rolls and solidifying the molten steel to form metal shells on casting surfaces of the casting rolls having nitrogen and hydrogen levels reflected by the content of the molten steel to provide for the formation of thin steel strip; and forming solidified thin steel strip through the nip between the casting rolls to produce a solidified steel strip delivered downwardly from the nip.

15. The method of claim 13 where the free hydrogen content is between 1.0 and 6.5 ppm.

16. The method of claim 12 where the sum of partial pressure of nitrogen and partial pressure of hydrogen in the introduced molten metal is no more than 1.0 atmosphere.

* * * * *